United States Patent [19]

Olshefsky

[11] 4,296,880

[45] Oct. 27, 1981

[54] COMBINATION STORAGE AND CARRYING DEVICE

[76] Inventor: Frank A. Olshefsky, 3578 Guilderland Rd., Schenectady, N.Y. 12306

[21] Appl. No.: 53,863

[22] Filed: Jul. 2, 1979

[51] Int. Cl.[3] ..... A47G 23/06

[52] U.S. Cl. ..... 294/144; 294/169; 220/95

[58] Field of Search ..... 224/48 R, 48 D, 48 B, 224/45 E, 45 W, 46 T, 45 D, 45 F, 45 G, 45 H, 45 K, 45 N, 45 P, 45 Q, 45 T, 46 R, 47; 229/23 A, 23 AB; 206/216; 220/95, 17.2, 19

[56] References Cited

U.S. PATENT DOCUMENTS

| | | | |
|---|---|---|---|
| 111,463 | 1/1871 | Manneck | 229/23 A |
| 653,907 | 7/1900 | Duden | 224/48 B |
| 703,050 | 6/1902 | Duthie | 224/45 P |
| 798,754 | 9/1905 | Taylor | 224/48 R |
| 894,974 | 8/1908 | Nicodemus | 224/48 R |
| 1,495,548 | 5/1924 | Cline | 220/95 |
| 1,728,521 | 9/1929 | Anderson | 224/48 R |
| 2,148,439 | 2/1939 | Crawford | 224/48 R |
| 2,333,757 | 11/1943 | Whitaker | 224/48 R |
| 2,436,524 | 2/1948 | Oberman | 224/45 W |
| 2,477,905 | 8/1949 | Shepard | 220/95 |
| 2,892,578 | 6/1959 | Sickrey | 224/46 R |
| 2,994,463 | 8/1961 | Drader | 224/48 D |
| 3,927,812 | 12/1975 | Winters et al. | 224/48 R |
| 4,040,550 | 8/1977 | Kleinert | 224/45 P |

*Primary Examiner*—Robert J. Spar
*Assistant Examiner*—Kenneth Noland
*Attorney, Agent, or Firm*—Pollock, Vande Sande & Priddy

[57] ABSTRACT

The present invention relates to a combination storage and carrying device for holding and transporting a plurality of items, such as stacked firewood, wherein the device includes a support assembly and a pair of handles pivotally attached thereto. The support assembly includes a base member and a plurality of attached side wall members for retaining items positioned on the base member. Each of the handles pivots between fully extended and fully retracted positions as needed, and the handles include end portions which elevate the support assembly above a support surface.

10 Claims, 12 Drawing Figures

COMBINATION STORAGE AND CARRYING DEVICE

BACKGROUND OF THE INVENTION

The present invention is directed to a combination storage and carrying device uniquely adaptable for holding and transporting a plurality of stacked items, such as firewood and the like.

In recent years, there has been a resurgence in the use of wood-burning fireplaces and stoves to provide a supplemental, and in some instances, the main source of heat for residential and commercial dwellings. Fireplaces also serve the additional function of providing enjoyment, while many wood-burning stoves are actually used for cooking. Conventionally, firewood is stacked adjacent to the dwelling and, as the need arises, a quantity of firewood is carried by hand from the stack to a woodbox or the like located adjacent the fireplace or stove. Such a procedure has proven less than completely satisfactory for several reasons. Because conventional woodboxes can only hold a relatively small quantity of firewood, frequent trips to the wood stack are usually necessary in order to keep the fire going. Furthermore, in climates subject to moderate or severe winters, the logs forming the stack tend to freeze to one another, forming a solid mass of wood and making separation of individual logs difficult, time-consuming and dangerous to the health of anyone attempting to pry the logs apart from such a frozen stack during the coldest periods of the winter. Finally, conventional wood stacks often collapse under the accumulation of snow or in the face of especially adverse weather conditions because of the lack of direct or lateral support for the stacked logs.

In an attempt to reduce the number of trips between the wood stack and the fireplace in bad weather, it has been suggested that a wood holder be positioned in an area protected from the weather, such as a porch or garage. A relatively large quantity of firewood could then be transferred from the wood stack to such a wood holder, which is usually a hoop-shaped assembly, with a smaller quantity of wood subsequently being transferred between the wood holder and the woodbox as required. While such an assembly can reduce the number of trips to the wood stack, it cannot overcome the often serious problems associated with removing frozen logs from the stack itself. Finally, the awkward shape of conventional holding assemblies such as the hoop-shaped assembly make it difficult to transport the holder when filled, while at the same time allowing the wood to easily slip from the holder when not stacked tight.

In comparison, applicant's present invention provides a combination storage and carrying device capable of storing a quantity of stacked items, such as firewood, over an extended period of time in the face of adverse weather conditions without the danger of collapse. By positioning a plurality of the storage devices adjacent one another and above one another, a quantity of wood can be stacked which will not collapse under the accumulation of snow. Furthermore, as logs are required for the fireplace or stove, one or more of the filled storage devices can be easily transferred to the dwelling without affecting the stability of the remaining devices. Because the storage device also functions as a carrying device, a quantity of stacked logs can be easily transported without the danger of one or more logs slipping from the device as in the prior art. The device also includes uniquely shaped handles which elevate the base member from contact with a support surface, thereby allowing the storage and carrying device to be positioned on a polished floor or carpet without damaging the surface thereof. This, in turn, allows the large capacity storage and carrying device of the present invention to replace the conventional, small capacity woodbox for storing wood immediately prior to use.

As pointed out hereinabove, the present invention is not intended to be used solely for the storage and carrying of firewood. Rather, the present invention is intended for use in storing and carrying almost any type of item or items which can be balanced on a support assembly of the device. In a preferred embodiment of the present invention, loads in excess of two hundred pounds can be safely lifted without damaging the support assembly and attached handles.

OBJECTS AND SUMMARY OF THE PRESENT INVENTION

An object of the present invention is to provide a combination storage and carrying device including a pair of handle members mounted on opposite sides of the device to provide lateral support for one or more items positioned on the device.

A further object of the present invention is to provide a storage and carrying device having a substantially rectangular base member and a plurality of side wall members extending outwardly therefrom which function to retain one or more items positioned on the device.

Another object of the present invention is to provide a storage and carrying device wherein the handles are pivotable between a fully retracted position and a fully extended position, with the base member being elevated above a support floor when the handles are in either position.

Another object of the present invention is to provide a storage and carrying device capable of holding and transporting a quantity of stacked firewood in excess of 200 lbs.

Each of these objects is achieved in a preferred embodiment of the present invention, wherein the device includes a support assembly having a substantially square base member with substantially perpendicular side walls extending about and attached to the periphery of the base member for retaining firewood and the like positioned on the base member. A pair of oppositely disposed side walls are each formed with a pair of flap-like extensions attached to end portions of the respective side walls. During assembly, the extensions are bent and welded into attachment with the remaining pair of oppositely disposed side walls in order to form a unitary frame structure. Pairs of spaced apertures extend through the base member adjacent to each of the side walls formed with the flap-like extensions.

A substantially U-shaped handle includes end portions extending through one pair of the spaced apertures, while a further handle of similar, substantially U-shaped configuration extends through the remaining pair of spaced apertures. The end portions of each handle have a similar, deformed shape which prevents complete separation of either handle from the support assembly. In particular, each pair of end portions are smoothly bent toward the base member until an angle of substantially 45° is created between each of the end portions and the remaining portion of the respective handles. This ensures that neither handle can be accidently withdrawn through its respective pair of apertures.

The smoothly bent end portions also function to elevate the base member above a support surface. Each handle also includes a pair of angled portions attached to opposite leg portions of each handle, with the angled portions extending away from one another and positioned proximate to the smooothly bent end portions, respectively. The outwardly angled portions limit the distance each handle can be depressed through its respective pair of spaced apertures. Finally, a strap including hooks mounted on opposite end portions may be attached to each handle to allow for easy carrying of the device when filled with firewood and the like.

In the preferred embodiment of the present invention, the entire support assembly, namely the base member and the attached side wall members, is formed from a single piece of material. Materials such as heavy-duty steel, aluminum and even synthetic plastics can be used in forming the support assembly and handles of the device. When the device is not in use, the bend end portions tend to automatically pivot the handles into a retracted position adjacent the base member, thereby creating a compact unit which can be easily stored.

In a further embodiment of the present invention, a substantially square base member is integrally formed with a pair of oppositely disposed upturned end portions and a pair of substantially L-shaped side wall members are attached to the remaining, oppositely disposed end portions of the base member. The side wall members may include flap extensions which are fixedly attached to the upturned end portions of the base member to increase the strength of the support assembly, allowing lighter materials to be used in the construction of the device.

The present invention can be best understood from a reading of the following specification and claims in conjunction with the accompanying drawings, wherein similar elements are referred to and are indicated by similar reference numerals.

BRIEF DESCRIPTION OF THE DRAWINGS

The present invention can be best understood with reference to the accompanying drawings wherein.

DETAILED DESCRIPTION OF THE PREFERRED EMBODIMENT

Figure 1:
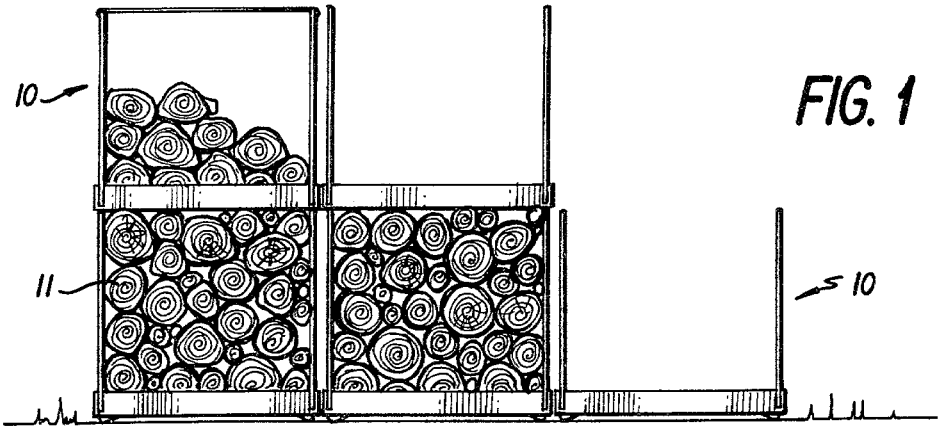
FIG. 1 shows a plurality of similar storage and carrying devices each formed in accordance with the present invention.

Referring to the drawings, and to FIG. 1 in particular, a plurality of separate storage and carrying devices 10 are arranged in a configuration particularly adaptable for the storage of firewood 11 and the like. In particular, a plurality of the storage devices 10 are positioned adjacent to one another and are filled with stacked firewood 11. As the devices 10 become filled, additional storage devices 10 can be vertically positioned on top thereof, with the stacked firewood 11 providing a support platform for the additional storage devices.

The arrangement shown in FIG. 1 is intended only as an example of a possible use for the present invention. It is to be understood that each storage and carrying device 10 is a completely separate unit which can be used entirely by itself for holding and transporting firewood as well as other types of items positioned thereon. Furthermore, a plurality of the devices 10 may conveniently be arranged in any type of configuration considered desirable for storing wood and the like.

Figure 2:
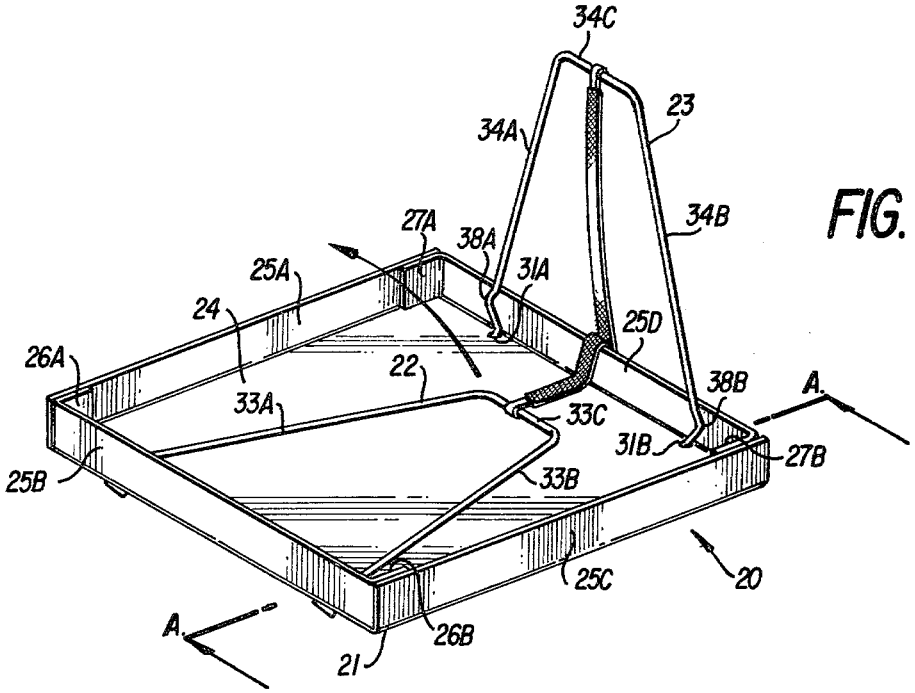
FIG. 2 shows a perspective view of a preferred embodiment of the present invention.

Turning to FIG. 2, a preferred embodiment of the storage and carrying device is generally indicated at 20. Device 20 includes a support assembly 21 and a pair of similarly-shaped arms 22 and 23 attached to support assembly 21 in a manner to be described hereinafter. Support assembly 21 is made up of a base member 24 and a plurality of attached side wall members 25A-D, respectively. In a preferred embodiment, base member 24 has a substantially square configuration. However, it is within the scope of the present invention to employ a base member of rectangular, elliptical or even circular configuration.

Figure 4:
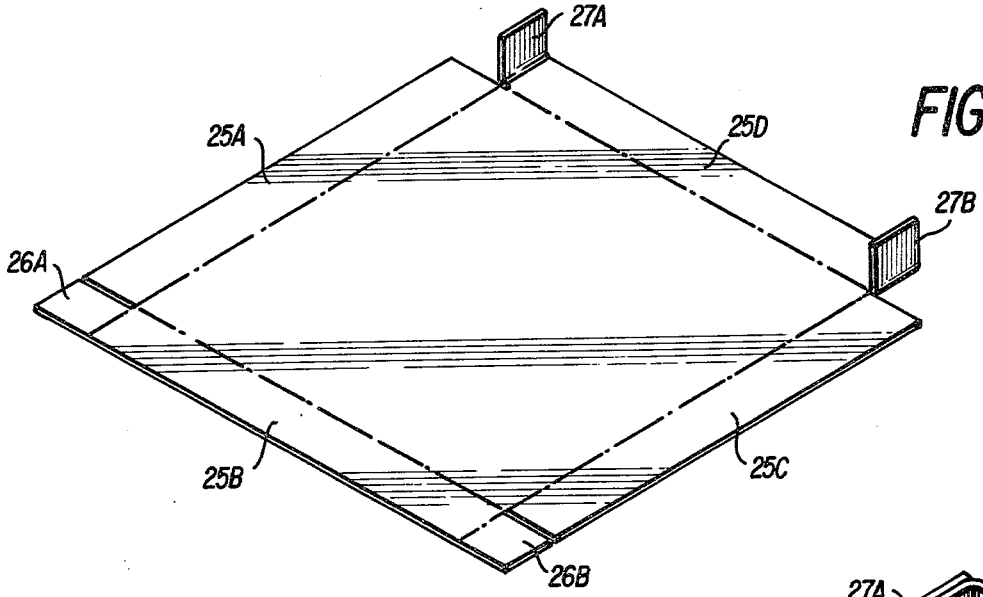
FIG. 4 shows a perspective view of the base member of FIG. 1 prior to assembly.

As shown in FIG. 2, each of the side wall members 25A-D extends in a direction substantially perpendicular to base member 24. Furthermore each of the side wall members 25A-D is attached to an edge portion of base member 24, such that the end surfaces of the side wall members 25A-D are positioned adjacent to one another. Side wall portions 25B and 25D are formed with a pair of flaps or ear portions attached to opposite ends thereof, and generally designated at 26A, B and 27A, B, respectively. Referring to FIG. 4, each of the flap portions 26A, B and 27A, B are bent to form a substantially right angle with the side wall members 25B and 25D, respectively. This allows flap portions 26A and B to abut surfaces of side wall members 25A and 25C, respectively. In a like manner, flap portions 27A and B also abut surfaces side walls 25A and 25C, respectively. Flap portions 26A, 26B and 27A, 27B are fastened to side wall members 25A and 25C as by tack welding, adhesive or conventional screw fasteners. As a result, the side wall portions 25A-D form a unitary frame which increases the overall strength of the support assembly and helps retain firewood and the like when stored and/or transported on base member 24.

In the preferred embodiment of the present invention, the entire support assembly 21 is formed from a single piece of material cut and formed into proper shape. The material may be selected from a resin-based plastic compound or from any of a variety of metallic substances such as heavy-duty steel or light-weight aluminum. Depending on the specific material employed, the device 20 is capable of supporting and lifting at least 200 lbs, and up to 500 lbs. of firewood and the like stacked on support assembly 21.

Figure 3:
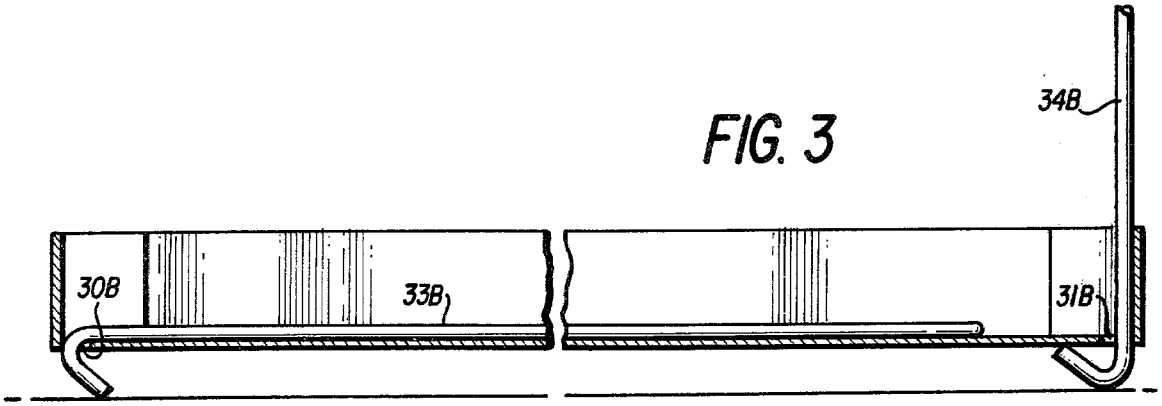
FIG. 3 shows a cross-sectional view of the embodiment of FIG. 1 taken along the section lines A—A.

Referring to FIGS. 2 and 3, first and second pairs of spaced apertures 30A, 30B, and 31A,31B each extend through base member 24. Apertures 30A, B are positioned adjacent to side wall member 25B, with only aperture 30B being visible in FIG. 3. Apertures 31A, B are positioned adjacent to side wall member 25D, such that an imaginary plane extending between apertures 30A and 31A or 30B and 31B will extend substantially parallel to side wall members 25A and 25C, respectively. Finally, both pairs of apertures 30A, 30B, and 31A,31B are positioned on base member 24, such that a single imaginary plane will bisect both pairs of apertures and will intersect the center of gravity of support assembly 21. As will become clear hereinafter, it is necessary to balance the pairs of apertures on either side of the center of gravity of support assembly 21 to insure that the device will not tip to one side when lifted.

The handles 22 and 23 are identical to one another and each is formed with a substantially U-shaped configuration. In particular, handle 22 includes a pair of leg members 33A and 33B interconnected by a connecting member 33C, while handle 23 includes a pair of leg members 34A and 34B interconnected by a connecting member 24C. As clearly shown in FIG. 7, the leg members 33A and 33B of handle 22 bow away from one another with the distance between the free end portions of elgs 33A and 33B being greater than the distance between apertures 30A and 30B, respectively. In a like manner, legs 34A and 34B also bow away from one another with the distance between the free ends of legs 34A and 34B being greater than the distance between the apertures 31A and 31B, respectively.

To attach handles 22 and 23 to support assembly 21, each pair of legs is compassed toward one another a sufficient distance to allow each pair of legs to be pressed through the pairs of apertures 30A, 30B and 31A, 31B, respectively. This ensures that the legs 33A, 33B and 34A, 34B will remain in contact with the base member 24, thereby preventing the handles from slipping relative to one another. As best shown in FIG. 3, leg 33B includes an end portion 35B which is smoothly bent toward base member 24 until an angle $\alpha$ of substantially 45° is created between end portion 35B and an adjacent portion of leg 33B. This results in end portion 35B having a substantially hook-shaped configuration. In a similar manner, the end portion 36B of leg 34B is also smoothly bent toward base member 24 until an angle $\alpha$ of substantially 45° is formed between leg 34B and end portion 36B. The end portions 35A and 36A (not shown) are also smoothly bent to form angles of substantially 45° with respective legs 33A and 34A. In a preferred embodiment, end portions 35A and 36A are aligned with one another, while end portions 35B and 36B are aligned with one another as shown in FIG. 3.

The bent end portions 35A, 35B and 36A, 36B serve to prevent handles 22 and 23 from being completely withdrawn from engagement with support assembly 21. Furthermore, the bent end portions cause handles 22 and 23 to pivot and collapse against base member 24 when the handles are not in use. Finally, the end portions function to contact and elevate base member 24 above a support surface, irrespective of the position of the handles 22 and 23.

Figure 7:
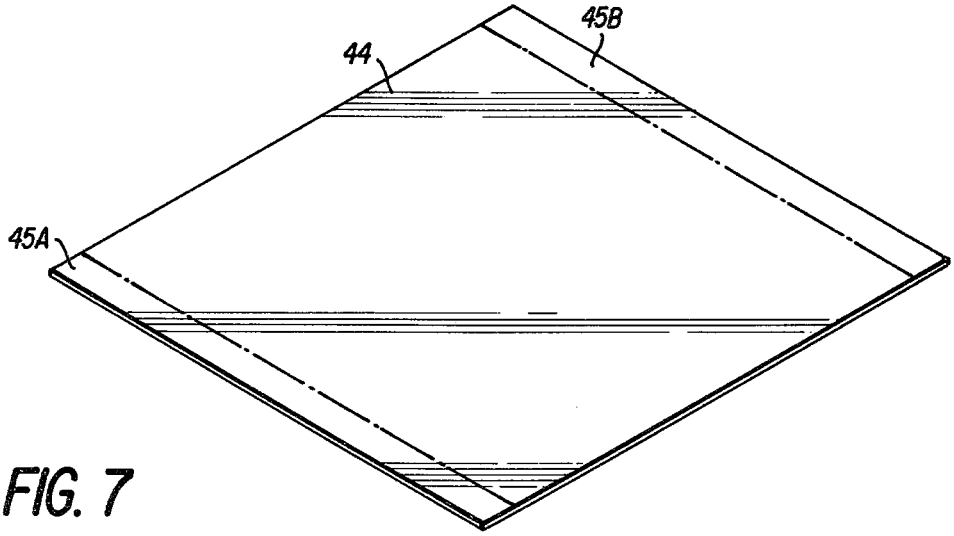
FIG. 7 shows a perspective view of a base member employed in the embodiment of FIG. 5 prior to deformation.

Each of the leg members 33A, 33B and 34 A, 34B also includes a similarly-shaped angled section designated 37A, 37B and 38A, 38B, respectively, wherein angled sections 37A, and 37B are shown in FIG. 7 and angled sections 38A and 38B are shown in FIG. 1. Each of the angled sections is positioned proximate to an adjacent end portion of the respective legs 33A, 33B and 34A, 34B, respectively. Furthermore, in a preferred embodiment, each pair of angled sections extend away from one another. The angled sections function as a stop to limit the distance which the handles 22 and 23 can be pressed through the apertures formed in base member 24.

Figure 5:
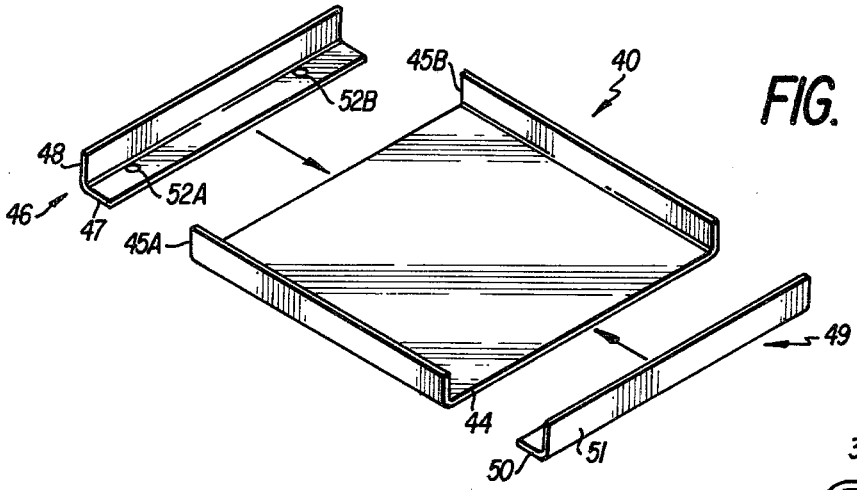
FIG. 5 shows a perspective partially exploded view of an alternative embodiment of the present invention.
Figure 8:
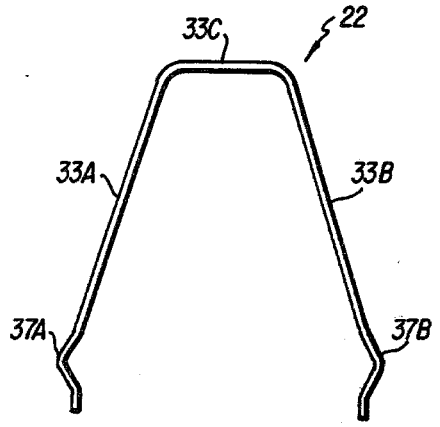
FIG. 8 shows a handle member of the type employed in each of the embodiments of the present invention.
Figure 6:
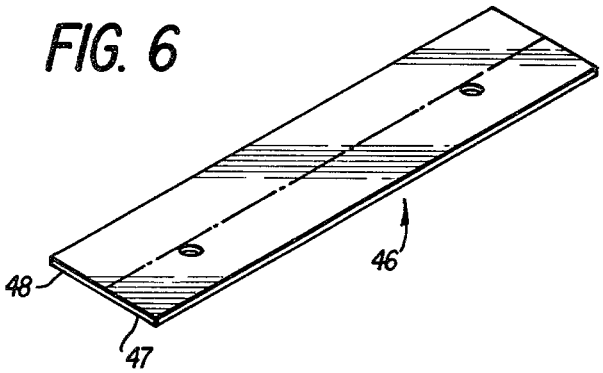
FIG. 6 shows a perspective view of a side wall member employed in the embodiment of FIG. 5 prior to deformation.

Referring now to FIG. 5, a further embodiment of the present invention is generally designated at 40. The storage and carrying device 40 includes a base member 44 which may be substantially similar in configuration to base member 24 defined hereinabove. Initially, base member 44 is substantially flat and includes a pair of parallel extending end portions 45A and 45B, respectively. Before assembly, each of the end portions 45A and 45B are smoothly bent toward the same side of base member 44 until each end portion forms an angle of substantially 90° with base member 44. An L-shaped side wall member 46 includes a base portion 47 and a side portion 48. A similar L-shaped side wall member 49 includes base portion 50 and a side portion 51. Each of the side wall members 46 and 49 has a length which substantially corresponds to the straight line distance between deformed end portions 45A and 45B, respectively. A first pair of apertures 52A and 52B extend through base portion 47 of side wall 46, while a second similar pair of apertures 53A and 53B (not shown) extend through base portion 50 of side wall 49. Apertures 52A, 52B and 53A, 53B are positioned adjacent to side portions 48 and 51, respectively, in a manner identical to the positioning of the pairs of apertures 30A, 30B and 31A, 31B adjacent to side walls 25B and 25D.

During assembly, end portions of handle 22 are pressed through apertures 52A, and 52B while end portions of the remaining handle 23 are pressed through the apertures 53A and 53B, respectively. Side wall member 46 is then positioned such that base member 44 overlaps base portion 47 and an end surface of base member 44 is substantially aligned with an edge of each of the apertures 52A and 52B. Base member 44 and base portion 47 of side wall member 46 are then fixedly attached to one another by welding, adhesive or the like. In a similar manner, base member 44 also overlaps base portion 51 of side wall member 49 a sufficient distance to align a opposite edge of base member 44 with an edge of each of the apertures 53A and 53B, respectively. Base member 44 is fastened to base portion 51 by welding, adhesive or the like.

Figure 10:
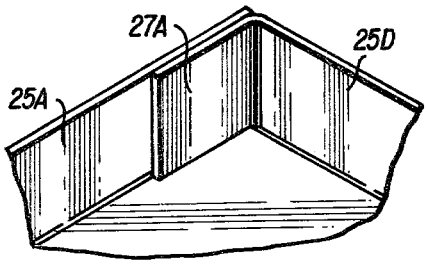
FIG. 10 shows a perspective view of a corner section of the embodiment of FIG. 9.
Figure 9:
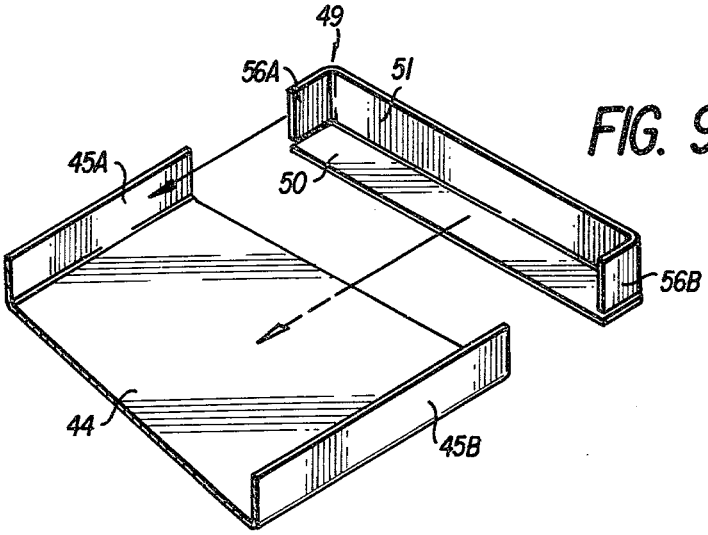
FIG. 9 shows a partially exploded view of a yet further embodiment of the present invention.
Figure 11:
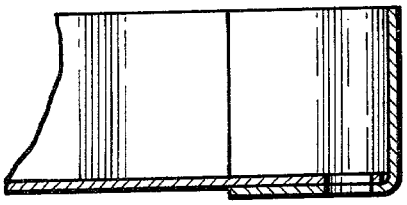
FIG. 11 shows a cross-sectional view of the attachment between a side wall and the base member in the embodiment of FIG. 9.
Figure 12:
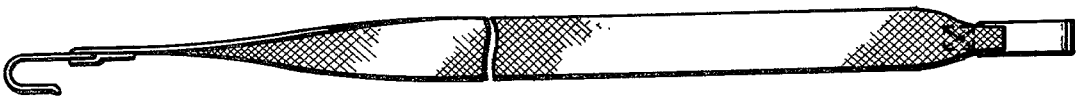
FIG. 12 shows a top view of a strap assembly employed with each of the embodiments.

In a further embodiment of the present invention, as shown in FIGS. 9–11, base member 44 and the L-shaped side wall members 46 and 49 are similar to the structure defined in the preceding embodiment. However, a first pair of flap-like extensions 55A and 55B (not shown) are attached to opposite edge surfaces of side portion 48 of side wall member 47. In a like manner, a further pair of flap-like extensions 56A and 56B are attached to opposite edge surfaces of side portion 51 of side wall member 49. Flaps 55A and 56A are deformed until they extend directly toward one another and flaps 55B and 56B are deformed until they extend directly toward one another, whereby each pair of flaps make abutting contact with a pair of deformed end portions 45A and 45B of base member 44. Referring to FIG. 10, flap 56A is fixedly attached by welding, adhesive or conventional screw fasteners to end portion 45A, with the remaining flap-like extensions attached to either end portion 45A or 45B in a similar manner in order to form a unitary frame structure of increased strength. Finally, a strap 70 formed of any conventional cloth-like material and including a pair of metal hooks 71 and 72 attached to opposite ends may be removably attached to handles 22 and 23 to allow for easy pick-up of any of the storage devices formed in accordance with the present invention.

As with the preferred embodiment of FIG. 2, the storage device disclosed in the alternative embodiments of FIGS. 5 and 9 can also be formed of a variety of materials, including but not limited to: resin-based plastics, metallic substances such as steel or aluminum or combinations of two or more such materials. Likewise, the actual size of the base, sidewall and handle members can vary depending on the length of the particular items to be carried. For example, a properly deformed sheet of material having initial dimensions of 20 inches×16 inches would form a base member sufficient in size to easily hold logs up to 16 inches in length, which is a standard length used to define a face cord. Likewise, a smaller piece of material, 16 inches ×16 inches will form a base member of sufficient size to easily hold logs up to 12 inches in length, which is a standard length for defining a stove cord.

The present invention is not to be limited to the above embodiments, but is only to be limited by the subject matter appearing in the following claims.

What is claimed is:

1. A combination storage and carrying device for transporting and storing a quantity of firewood and the like, and comprising:

a substantially flat base portion having first and second pairs of spaced apertures extending therethrough;

a first handle member positioned on an upwardly facing side of said base portion and having a pair of separate leg sections extending through and beyond said first pair of apertures to a downwardly facing side of said base portion, and a second handle member also positioned on said upwardly facing side of said base portion and having a pair of separate leg sections extending through and beyond said second pair of apertures;

each leg section extending through and beyond one of said apertures including first and second portions having longitudinal axes forming an acute angle, and a third, smoothly curved portion joining said first and second portions to one another, whereby the first portions of a pair of leg sections forming a handle member rest against the upwardly facing side of said base portion and the second portions contact a storage support surface to elevate said base portion above said storage support surface when said respective handle member assumes a fully reclined position, whereby the third portions of each pair of leg sections forming a handle member contact the storage support surface and the second portions each contact a downwardly facing side of said base portion to elevate said base portion above said support surface when said respective handle member assumes a fully open position;

side wall means extending from predetermined locations on the upwardly facing side of said base portion for resisting pivotal movement of said first and second handle members away from said upwardly facing side of said base portion beyond a predetermined location corresponding to their fully open positions.

2. A device according to claim 1, including an elongated flexible strap member having a pair of hook-shaped end portions releasably engaging said handle members.

3. A storage and carrying device according to claim 1, wherein said side wall means comprises an integral extension of said base portion extending substantially perpendicular to the remaining, substantially flat upwardly facing surface of said base portion.

4. A storage and carrying device according to claim 3, wherein said side wall means further comprises four separate side wall members positioned end to end and forming a substantially rectangular configuration, with separate connecting flanges extending between and joining each pair of adjacently disposed side wall members to form a unitary frame surrounding said base portion.

5. A storage and carrying device according to claim 1, wherein said side wall means comprises a first pair of side wall members each forming an integral extension of said base portion extending substantially perpendicular to the upwardly facing side of said base portion;

said side wall means further comprising a second pair of substantially L-shaped side wall members, each having a first portion overlapping and fixedly attached to said base portion and a second portion extending perpendicular to said first portion.

6. A storage and carrying device according to claim 5, wherein a separate pair of apertures extends through the first portion of each L-shaped side wall member, with each pair of apertures aligned with one of said first and second pairs of apertures extending through said base portion to allow for insertion of one of said first and second handle members therethrough.

7. A storage and carrying device according to claim 5, wherein each of said L-shaped side wall members including a pair of flanges extending from opposite end portions thereof, with each flange fixedly engaging one of said first pair of side wall members to form a unitary frame structure surrounding said base portion.

8. A combination storage and carrying device according to claim 1, wherein each handle member includes a substantially U-shaped connecting portion extending between, and integrally joining a pair of said leg sections.

9. A storage and carrying device according to claim 1, wherein each leg section includes a bowed portion positioned adjacent said upwardly facing side of said base portion, with bowed portions of each pair of leg sections extending away from one another to limit insertion of each handle member through said first and second pairs of apertures.

10. A storage and carrying device according to claim 1, wherein said flat base portion has a substantially square configuration and is formed of a resin-based plastic material.

* * * * *